US005140641A

United States Patent [19]

Danley et al.

[11] Patent Number: 5,140,641

[45] Date of Patent: Aug. 18, 1992

[54] SERVO VALVE LOUDSPEAKER

[75] Inventors: Thomas J. Danley, Highland Park; Charles A. Rey, Riverwoods, both of Ill.

[73] Assignee: Intersonics Incorporated, Northbrook, Ill.

[21] Appl. No.: 689,366

[22] Filed: Apr. 22, 1991

[51] Int. Cl.[5] ..... H04R 25/00

[52] U.S. Cl. ..... 381/156; 381/165; 381/153; 340/404; 340/405

[58] Field of Search ..... 381/165, 153, 156; 340/405, 404

[56] References Cited

U.S. PATENT DOCUMENTS

| | | | |
|---|---|---|---|
| 3,936,606 | 2/1976 | Wanke | 381/154 |
| 4,649,853 | 3/1987 | Powell | 340/405 |
| 4,763,358 | 8/1988 | Danley | 381/153 |
| 4,847,590 | 7/1989 | Gosswiller | 340/405 |

*Primary Examiner*—Jin F. Ng
*Assistant Examiner*—Huyen D. Le
*Attorney, Agent, or Firm*—Juettner Pyle & Lloyd

[57] ABSTRACT

Low frequency, high intensity sound is produced using a conduit having a flow of high velocity and low pressure air. A pair of sound ports are provided in the conduit, and a rotary valve connected to a reversible servomotor and audio source is employed to direct the flow of air toward and away from the ports.

10 Claims, 2 Drawing Sheets

SERVO VALVE LOUDSPEAKER

BACKGROUND OF THE INVENTION

This invention relates to a method and apparatus for producing sound in which an internally generated flow of air is provided, and a valve is employed to modulate the air flow to produce sound waves.

The modulation of air flowing at high pressures to produce high intensity sound is a well known technique. The rotary siren is one example of such a device, in which a rotary valve is used to modulate a flow of air under high pressure. In the case where a random wave form is to be produced, such a voice, music, or other complex sounds, the valve which modulates the pressurized air flow is typically driven by an electromagnetic transducer, such as a voice coil, connected to an electronic audio source.

While devices of the foregoing nature can produce sound at high levels or intensities, i.e., up to ten thousand acoustic watts, they suffer from significant shortcomings. Since all these devices use high pressure air, typically 10 to 50 PSI or more, and are controlled by a single valve that is half open when there is no signal, they produce high noise levels, non-linearities, and sound distortion. Net air flow from the port of the device is also produced. Also, almost all of such devices depend on an acoustic horn to provide most of the acoustic loading. This, in turn, limits operation to frequencies which are high enough where the horn can be of a practical size or length. The lower the frequency, the larger the horn required.

As an example of the above limitation, in order to produce a sound at 3 Hz using the above high pressure devices, the proper horn length would be in the order of 100 feet, and the mouth diameter would have to be in the order of about 90 feet. For this reason, these prior art devices are ill suited to low frequency operation.

SUMMARY OF THE INVENTION

An object of the present invention is to produce a high acoustic output at low frequencies without net air flow, and without high noise or distortion levels, and without the use of large horns.

The foregoing objectives are accomplished by the provision of an air flow conduit loop having a pair of opposed ports therein. Means, such as a blower or fan, are provided for establishing a flow of air in one direction in the conduit, such air flow having a high velocity and low pressure differential relative to ambient pressure. Valve means such as a rotary vane is provided between the ports for adjustably directing or diverting the air flow outwardly through one port while diverting air flow inwardly from the other port, and vice-versa. The valve or vane is driven by an electromechanical transducer means such as a servomotor, which is in turn connected to an electrical source providing an alternating signal corresponding to the sound to be produced.

The valve or rotary vane is caused to rotate back and forth with an angular amplitude and frequency corresponding to the acoustic signal desired, with a frequency range in excess of one octave being attainable. The valve is configured such that, when there is no signal, the vane is in a medial position, allowing flow around the conduit with little change in direction. At maximum peak signal, the full flow velocity is communicated out of one port and in from the other. The output phase and amplitude then correspond to the input signal to the transducer. At low frequencies, the maximum sound pressure is determined by the maximum available air flow volume velocity, which is limited only by the displacement capacity of the flow producing means, such as the blower or fan.

The valves may be made as large as desired to minimize the pressure drop and will typically be at least one hundred times the effective size of valves in the prior art using pressurized air sources. As a result, the device of the present invention can simulate a large piston moving at high velocity, thereby producing a high degree of radiated power. Because the output volume velocity is communicated to the outside air, no horn is required, although an appropriate horn would increase the output. Because of the push-pull operation, there is no net air flow from the system. In addition, because of the low air pressures and large valve area, much less noise and distortion are produced.

THE DRAWINGS

DESCRIPTION OF THE PREFERRED EMBODIMENTS

Figure 1:
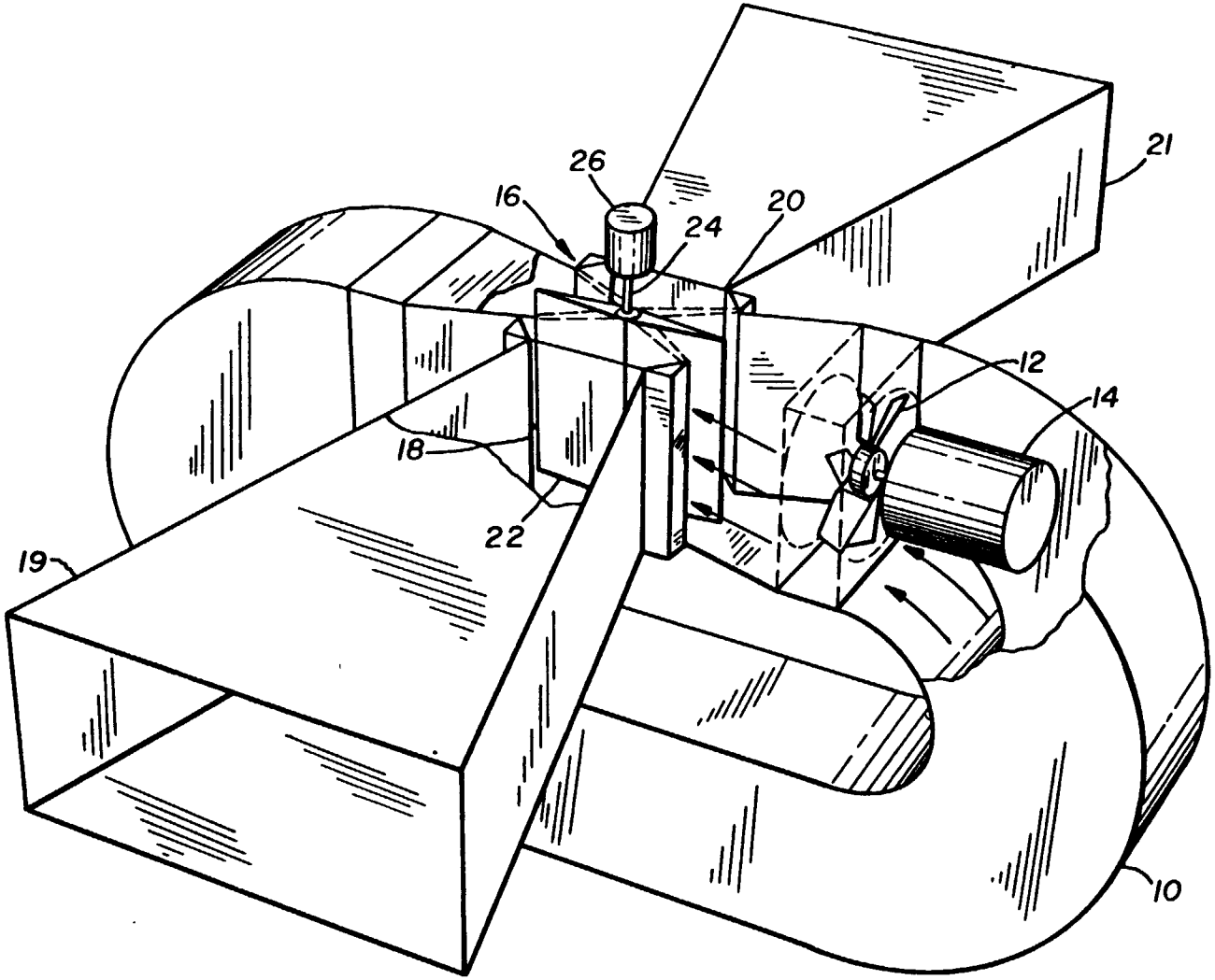
FIG. 1 is a perspective view of the apparatus of the present invention, with portions being broken away to reveal the inner structure.
Figure 2:
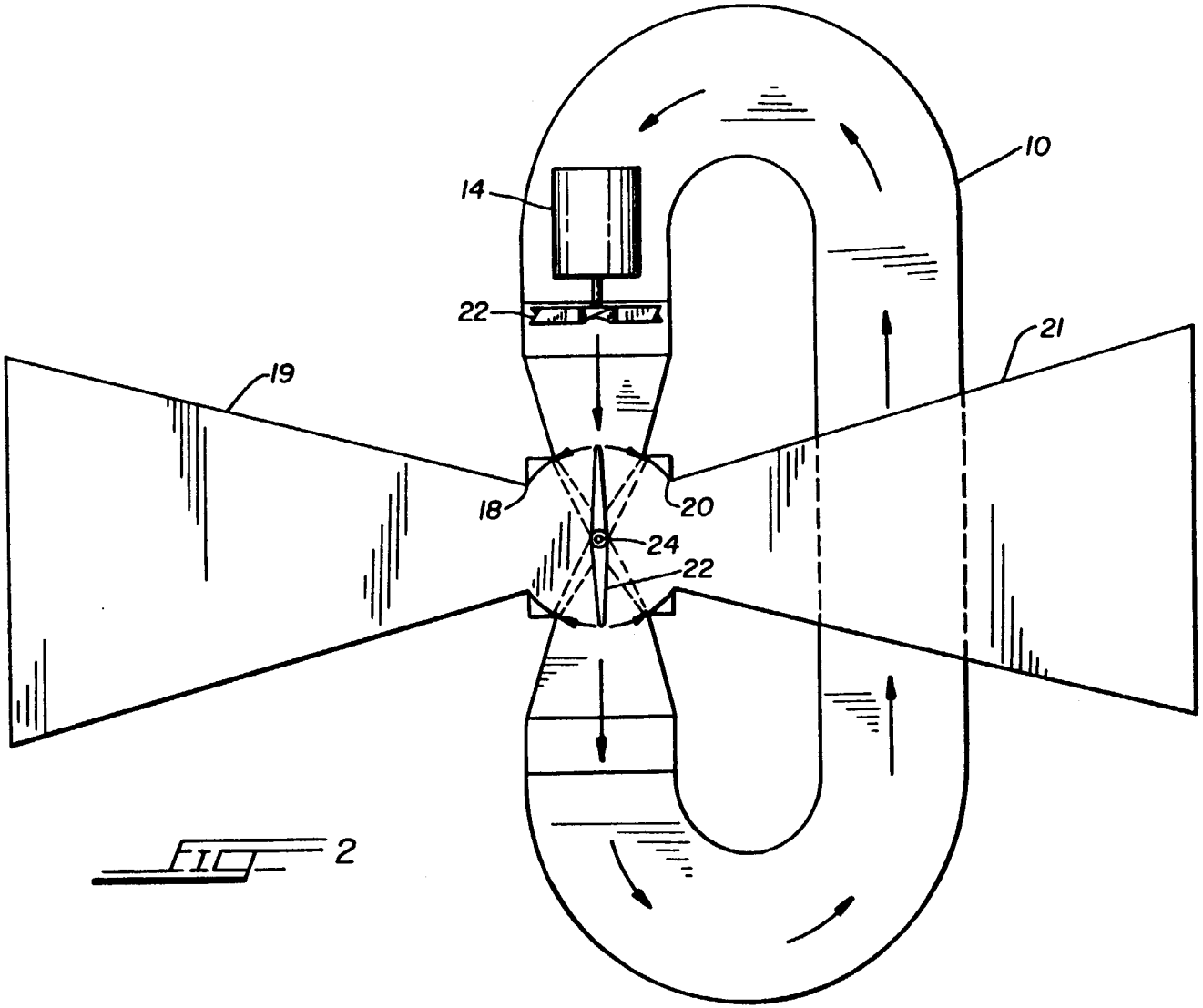
FIG. 2 is a schematic view of the apparatus shown in FIG. 1.

FIGS. 1 and 2 illustrate the apparatus of the present invention in both perspective and schematic form to provide a better understanding of the operation thereof. The apparatus comprises an unrestricted air flow conduit 10 having a uniform cross section along its length for containing and supplying a continuous flow of air. Air displacement means, such as a fan 12 connected to an electrical motor 14 is provided within the conduit 10 for creating a flow of air within the conduit in one direction, as indicated by the arrows, at low pressure differential and high velocity. Other types of conventional blowers may be provided for this purpose. The air pressure within the conduit is preferably less than 1 PSIG and most desirably less than 0.2 PSIG. The velocity of the air will depend on the size and type of device employed, and as shown, the velocity within the conduit is intended to be constant. Typical velocities will be in the order of at least ten feet per second to about one hundred feed per second and greater.

As shown, the conduit is in the form of a continuous self-contained loop having air outlet and inlet flows connected to a common valve chamber and valve mechanism, generally indicated at 16.

The valve mechanism 16 communicates with a pair of ports 18 and 20 in communication with the outside air. In the embodiment shown, the ports 18 and 20 are located in an opposed relation and are intended to radiate sound in opposite directions. Spreading or diffusion of the air from ports to the working area may be accomplished with the use of a tapered horn-like structure which provides little or no acoustic loading. These are shown as 19 and 21, each having a throat connected to the ports and a larger mouth at the end thereof.

The valve mechanism 16 may be in the form of a vane 22, rectangular in form, and having dimensions corresponding to the box-like dimensions of the valve chamber provided at a juncture of the conduit 10 and ports 18 and 20. The vane 22 is rotatable about a central vertical axis by means of securement to a central shaft 24 carried by suitable rotary bearings or the like in the structure.

Means are provided for rotating the shaft 24 and vane 22 in both rotary directions. Preferably, such drive means is in the form of a electromechanical transducer which converts electronic signals from an audio or other source into reversible mechanical rotary motion. As shown, the transducer may comprise a commutated servomotor 26 having an electrical connection by suitable leads to an alternating signal, such as an amplified audio signal.

The operation of the device is best understood by reference to FIG. 2. In the embodiment shown, the vane 22 is capable or rotation in either direction from the central position shown, in which the opposed edges of the vane are equally spaced from the ports through an angle of 45 degrees in either direction. In the central position shown, the vane 22 provides no or very little deflection of the air flow or loss of velocity, and no sound is produced, with the air flow being substantially recirculated in the conduit 10. Back and forth rotation of the vane 22 at a particular velocity and frequency causes an alternating air flow to be directed in and out of one of the ports 18–20, with a complementary and opposite air flow to be directed in and out of the other port. Thus, rotation of the vane back and forth will cause sound waves to be produced. The maximum or peak amplitude corresponds to the maximum rotation of the vane in either direction. In the embodiment shown, sound will be emitted from the respective horns 19 and 21 in opposite phases.

It may be seen that the size or area of the valve openings is limited only by practical considerations, and typically the valve opening area will be in the order of at least one and usually several hundred times larger than valves used in prior art devices operating on pressurized air. The device is, therefore, especially suitable for very low frequencies at high intensity. Also, due to the low pressure and balanced or push-pull operation, noise levels, distortions, and non-linearities are minimized. The device permits operation down to DC or 0 Hz.

We claim:

1. A device for producing sound of high intensity over a frequency range, said device comprising an air flow conduit having an inlet and an outlet, means for providing a high velocity, low pressure flow of air within said conduit from said inlet to said outlet, a pair of sound ports communicating with said inlet and said outlet and with the outside air, and valve means for adjustably directing the flow of air outwardly from said outlet through one of said ports and directing the flow of air inwardly from said inlet through the other of said ports.

2. The device of claim 1 wherein said ports are opposed and emit sound in opposite directions.

3. The device of claim 1 additionally comprising drive means for driving and valve means in response to an audio signal.

4. The device of claim 3 wherein said drive means comprises an electromechanical transducer.

5. The device of claim 4 wherein said transducer comprises a motor.

6. The device of claim 1 wherein said valve means comprises a chamber between said inlet and said outlet, and a rotatable vane disposed in said flow of air between said ports to alternatively direct positive and negative flows of air through said ports.

7. The device of claim 1 wherein the pressure of said flow of air is less than 0.2 PSIG.

8. The device of claim 1 wherein the velocity of said flow of air in said conduit is substantially constant.

9. A device for producing sound of high intensity comprising an air flow conduit in the form of a continuous loop, means for providing a flow of air at high velocity around said loop, a pair of opposed ports in said conduit open to the exterior, rotary valve means for directing a positive flow of air toward one port while directing a negative flow of air at the other port, said rotary valve means being rotatable in both directions to alternate the direction of air flow and thus to produce sound, and electromechanical transducer means connected to said rotary valve means for operation thereof in response to an electrical audio signal.

10. A servo valve loudspeaker capable of producing high intensity sound in response to an audio signal over a low frequency range, said loudspeaker comprising an air flow conduit in the form of a continuous loop, means in said conduit to create a continuous flow of air around said loop at a velocity greater than 10 feet per second and a pressure of less than 0.2 PSIG, a pair of opposed sound emitting ports in said conduit, vane means disposed between said ports operative to rotate back and forth around an axis for adjustably directing air flow in the conduit outwardly through one port while diverting air flow inwardly from the other port, and means for rotating said vane means in proportion to the frequency and amplitude of said audio signal to produce sound.

* * * * *